US009496600B2

(12) United States Patent
Irci et al.

(10) Patent No.: US 9,496,600 B2
(45) Date of Patent: Nov. 15, 2016

(54) ELECTRONIC DEVICE WITH ARRAY OF ANTENNAS IN HOUSING CAVITY

(71) Applicant: Apple Inc., Cupertino, CA (US)

(72) Inventors: Erdinc Irci, Sunnyvale, CA (US); Jerzy Guterman, Mountain View, CA (US); Jonathan Haylock, Los Angeles, CA (US); Mattia Pascolini, San Mateo, CA (US)

(73) Assignee: Apple Inc., Cupertino, CA (US)

( * ) Notice: Subject to any disclaimer, the term of this patent is extended or adjusted under 35 U.S.C. 154(b) by 350 days.

(21) Appl. No.: 14/053,104

(22) Filed: Oct. 14, 2013

(65) Prior Publication Data

US 2015/0102965 A1 Apr. 16, 2015

(51) Int. Cl.

| | |
|---|---|
| ***H01Q 21/00*** | (2006.01) |
| ***H01Q 1/24*** | (2006.01) |
| ***H01Q 1/42*** | (2006.01) |
| ***H01Q 9/04*** | (2006.01) |
| ***H01Q 21/28*** | (2006.01) |

(52) U.S. Cl.
CPC ..... *H01Q 1/24* (2013.01); *H01Q 1/42* (2013.01); *H01Q 9/0421* (2013.01); *H01Q 21/28* (2013.01)

(58) Field of Classification Search
CPC ..... H01Q 1/42; H01Q 1/24
See application file for complete search history.

(56) References Cited

U.S. PATENT DOCUMENTS

| | | | | |
|---|---|---|---|---|
| 6,121,936 | A * | 9/2000 | Hemming | H01Q 1/28 343/725 |
| 6,710,750 | B2 | 3/2004 | Dzieciol | |
| 7,619,568 | B2 | 11/2009 | Gillette | |
| 8,269,671 | B2 | 9/2012 | Chen et al. | |
| 8,279,130 | B2 | 10/2012 | Dietmeier | |
| 2009/0160713 | A1* | 6/2009 | Nielsen | H01Q 1/243 343/702 |
| 2009/0303693 | A1* | 12/2009 | Mao | H02J 17/00 361/818 |
| 2009/0322648 | A1* | 12/2009 | Bishop | H01Q 21/20 343/893 |
| 2011/0050508 | A1* | 3/2011 | Guterman | H01Q 1/2266 343/702 |
| 2011/0241948 | A1* | 10/2011 | Bevelacqua | H01Q 1/243 343/702 |
| 2012/0249378 | A1* | 10/2012 | Li | H01Q 1/243 343/702 |
| 2012/0256808 | A1* | 10/2012 | Owens | H01Q 1/2233 343/872 |
| 2013/0002517 | A1* | 1/2013 | Pascolini | H01Q 1/2266 343/878 |
| 2013/0088397 | A1* | 4/2013 | Mo | H01Q 1/243 343/702 |
| 2013/0127672 | A1 | 5/2013 | Zhu et al. | |
| 2014/0112511 | A1* | 4/2014 | Corbin | H05K 9/006 381/333 |
| 2014/0361936 | A1* | 12/2014 | Hallivuori | H01Q 1/243 343/702 |

* cited by examiner

*Primary Examiner* — Trinh Dinh
(74) *Attorney, Agent, or Firm* — Treyz Law Group, P.C.; G. Victor Treyz; Michael H. Lyons

(57) ABSTRACT

Metal housing walls may form an antenna cavity. Antenna structures may be formed from metal traces mounted on a carrier in the antenna cavity. The antenna structures may form an array of antennas such as an array of planar inverted-F antennas. The housing may have an inner cavity wall such as a circular inner cavity wall. The planar inverted-F antennas may lie between the inner cavity wall and the metal walls of the housing. Each planar inverted-F antenna may have an associated parasitic antenna resonating element. The planar inverted-F antennas may be configured to resonate in upper and lower frequency bands. The parasitic elements may each extend inwardly from the metal walls and may broaden the frequency response of the planar inverted-F antennas in the lower frequency band. Parasitic elements may be used to isolate antennas from each other.

7 Claims, 16 Drawing Sheets

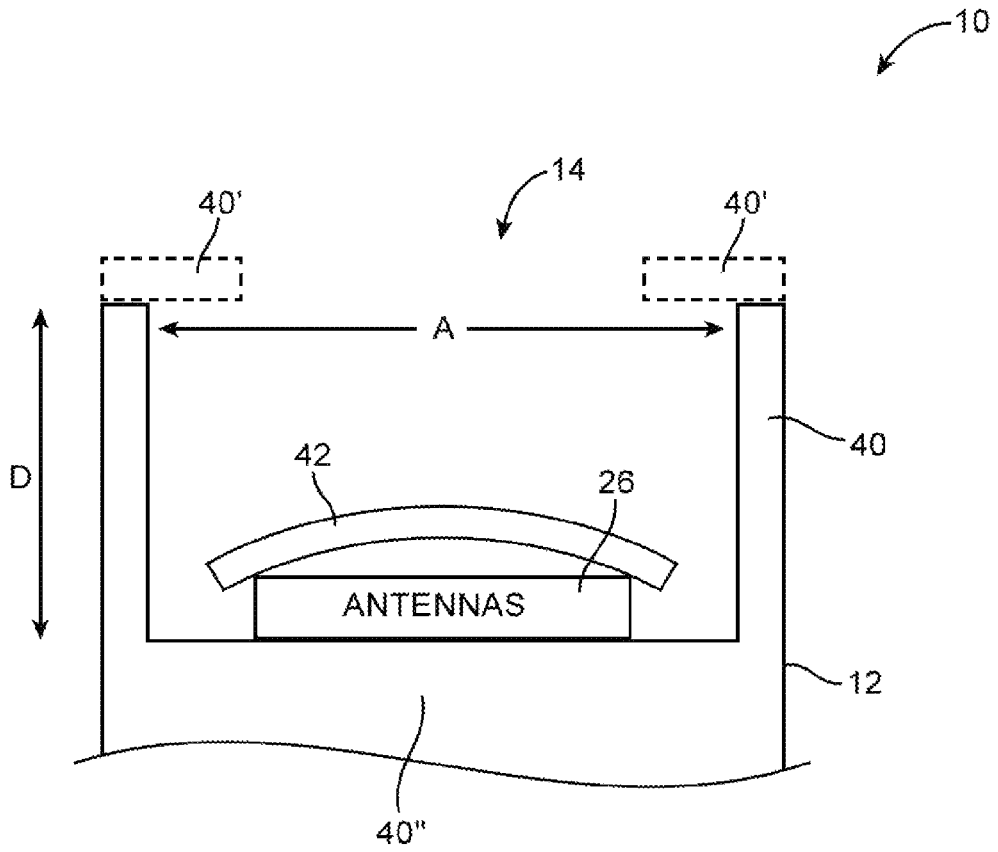
FIG. 3
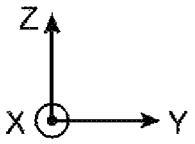

ELECTRONIC DEVICE WITH ARRAY OF ANTENNAS IN HOUSING CAVITY

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, wireless communications are handled using multiple antennas. If care is not taken, the presence of one antenna can adversely affect the performance of another antenna. The presence of conductive device structures such as housing walls can also give rise to antenna cavity modes that impact performance.

It would therefore be desirable to be able to provide improved antennas for use in an electronic device.

SUMMARY

An electronic device may be provided with a housing formed from metal housing walls. The metal housing walls may form an antenna cavity. For example, the metal housing walls may include a metal floor and metal sidewalls that extend upwards from the floor to form a cylindrical housing with a circular opening.

Antenna structures may be formed from metal traces mounted on a carrier in the antenna cavity. The carrier may have a circular shape that is received within a circular outer metal housing wall in the housing.

The antenna structures may form an array of antennas such as an array of planar inverted-F antennas. The housing may have an inner cavity wall such as a circular inner cavity wall. The planar inverted-F antennas may lie between the inner cavity wall and the metal walls of the housing.

Each planar inverted-F antenna may have an associated parasitic antenna resonating element. The planar inverted-F antennas may be configured to resonate in upper and lower frequency bands. The parasitic elements may each extend inwardly from the metal walls and may broaden the frequency response of the planar inverted-F antennas in the lower frequency band.

The planar inverted-F antennas may include first, second, and third antennas that are arranged in a circular array and are separated from each other by 120°. Parasitic elements may be formed between the planar inverted-F antennas to isolate adjacent antennas in the array from each other. Each antenna in the array may have a different respective polarization orientation to minimize antenna coupling.

BRIEF DESCRIPTION OF THE DRAWINGS

FIG. 3 is a cross-sectional side view of an illustrative electronic device in accordance with an embodiment.

DETAILED DESCRIPTION

Electronic devices may be provided with antennas. There may be multiple antennas mounted in the vicinity of each other in a device. For example, an array of two or three or more antennas may be used in a device. Isolation structures may be used to help decouple the antennas from each other. In electronic devices with conductive structures such as conductive housings, it may be desirable or necessary for the antennas to operate within an antenna cavity. The cavity may be formed from ground plane structures such as metal housing walls, traces on plastic carriers, internal metal device structures, and other conductive structures. The antennas may be located within the cavity while exhibiting satisfactory antenna performance and isolation.

Figure 1:
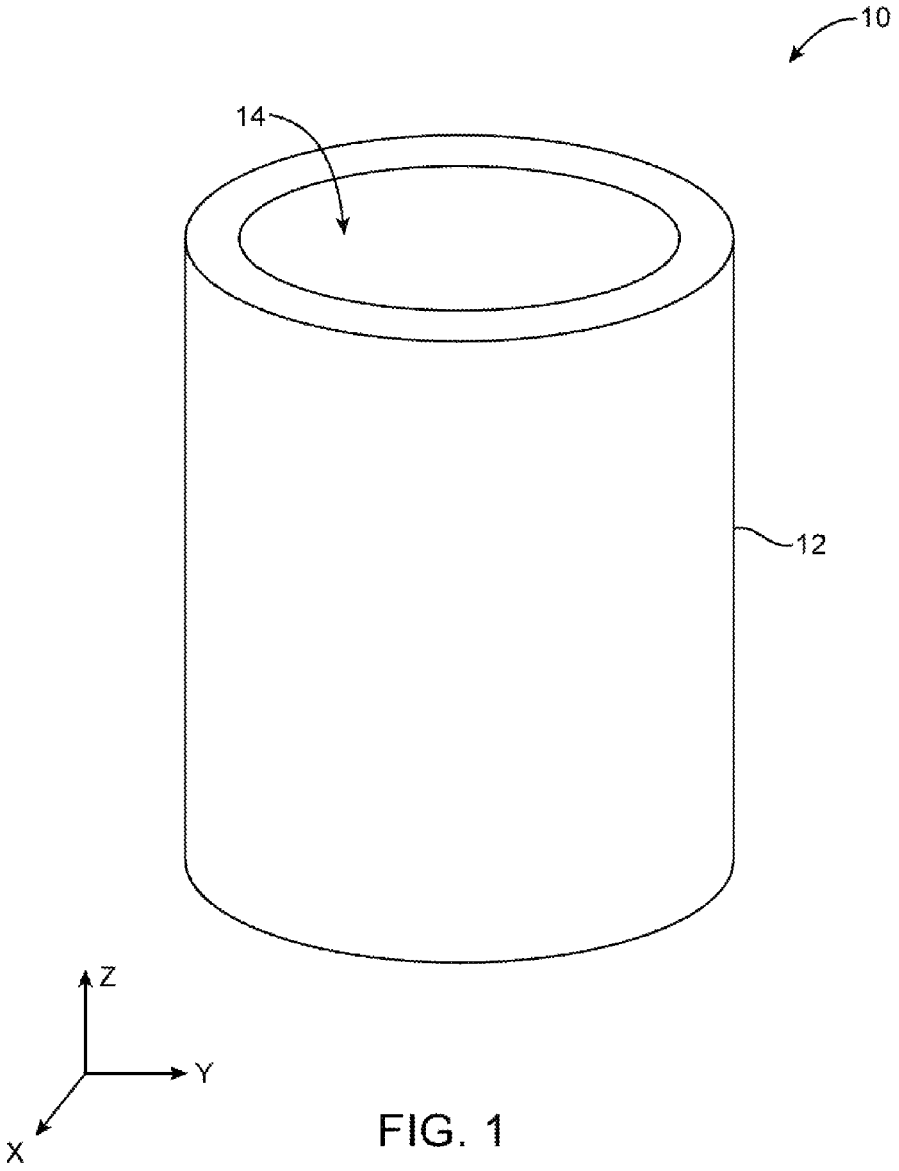
FIG. 1 is a perspective view of an illustrative electronic device in accordance with an embodiment.

An illustrative electronic device that may be provided with antennas is shown in FIG. 1. Electronic device 10 of FIG. 1 may have a cylindrical shape formed from a cylindrical housing 12. Housing 12 may be formed from plastic, fiber-composite materials, glass, ceramic, metal, other materials, or combinations of these materials. As an example, housing 12 may be formed from a metal such as aluminum or stainless steel. The cylindrical inner volume of device 10 may form a cavity such as cavity 14. Antennas in device 10 may be formed form antenna resonating element structures located within cavity 14.

In the FIG. 1 example, housing 12 has a cylindrical shape. Housing 12 may, if desired, have other shapes (e.g., rectangular box shapes, pyramidal shapes, shapes with curved edges, shapes with straight edges, shapes with combinations of planar and curved surfaces, etc.). The example of FIG. 1 is merely illustrative.

Electronic device 10 may be a computing device such as a computer (e.g., a laptop or desktop computer), a computer monitor containing an embedded computer, a tablet computer, a router, a modem, a wireless access point, a set-top box, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. As an example, electronic device 10 may be a desktop computer that is coupled to an external monitor using a cable and/or wireless signaling schemes.

Figure 2:
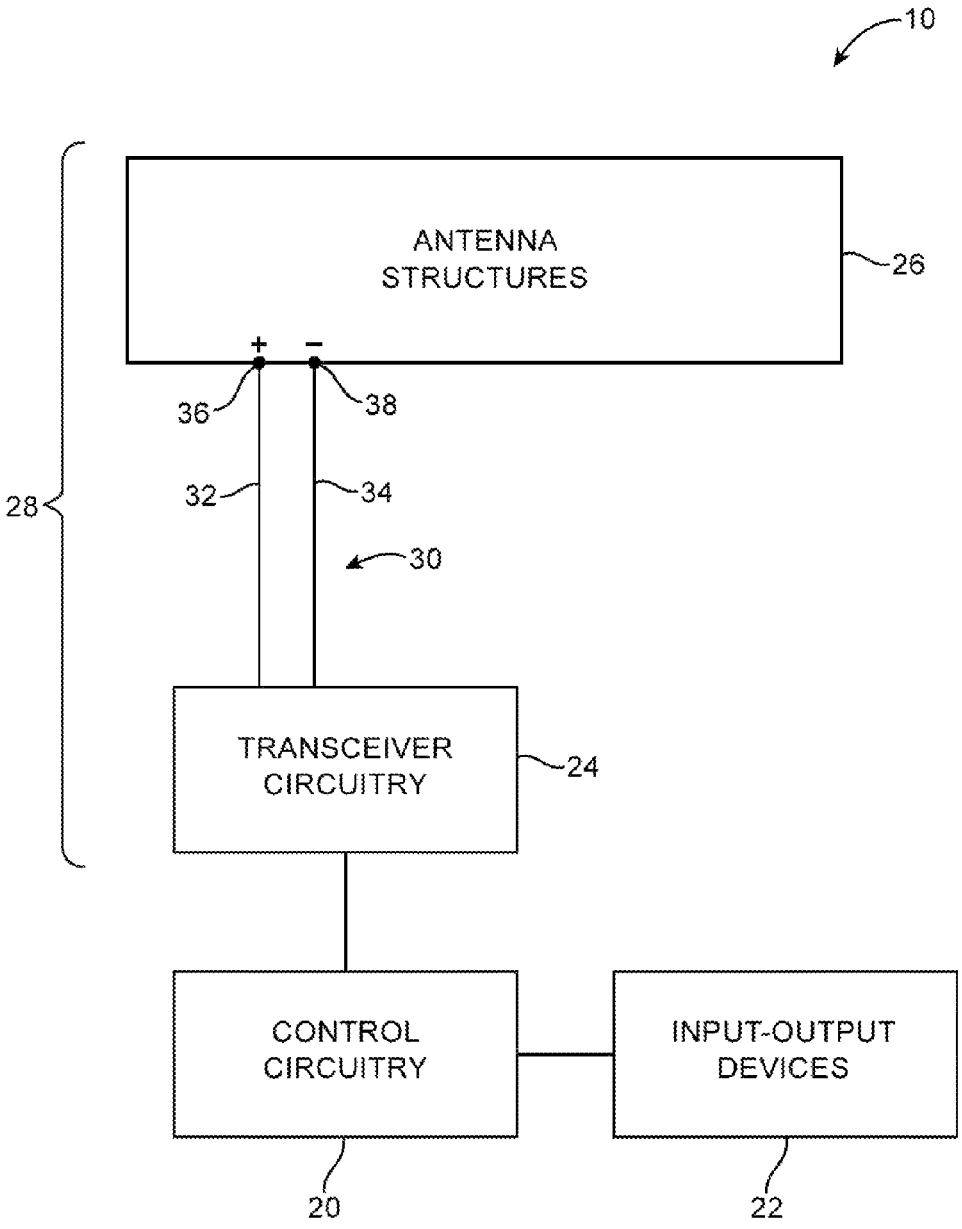
FIG. 2 is a schematic diagram of an illustrative electronic device in accordance with an embodiment.

A schematic diagram of device 10 is shown in FIG. 2. As shown in FIG. 2, electronic device 10 may include control circuitry 20. Control circuitry 20 may include storage and processing circuitry for controlling the operation of device 10. Control circuitry 20 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 20 may include processing circuitry based on one or more microprocessors, microcontrollers, digital signal processors, baseband processors, power management units, audio codec chips, application specific integrated circuits, etc.

Control circuitry 20 may be used to run software on device 10, such as operating system software and application software. Using this software, control circuitry 20 may, for example, transmit and receive wireless data, tune antennas to cover communications bands of interest, and perform other functions related to the operation of device 10.

Input-output devices 22 may be used to allow data to be supplied to device 10 and to allow data to be provided from device 10 to external devices. Input-output circuitry 22 may include communications circuitry such as wired communications circuitry. Device 10 may also use wireless circuitry such as transceiver circuitry 24 and antenna structures 26 to communicate over one or more wireless communications bands.

Input-output devices 22 may include input-output components with which a user can control the operation of device 10. A user may, for example, supply commands through input-output devices 22 and may receive status information and other output from device 10 using the output resources of input-output devices 22.

Input-output devices 22 may include sensors and status indicators such as an ambient light sensor, a proximity sensor, a temperature sensor, a pressure sensor, a magnetic sensor, an accelerometer, and light-emitting diodes and other components for gathering information about the environment in which device 10 is operating and providing information to a user of device 10 about the status of device 10. Audio components in devices 22 may include speakers and tone generators for presenting sound to a user of device 10 and microphones for gathering user audio input. Devices 22 may include one or more displays. Displays may be used to present images for a user such as text, video, and still images. Sensors in devices 22 may include a touch sensor array that is formed as one of the layers in a display. During operation, user input may be gathered using buttons and other input-output components in devices 22 such as buttons, joysticks, click wheels, scrolling wheels, touch sensors such as a touch sensor array in a touch screen display or a touch pad, key pads, keyboards, vibrators, cameras, and other input-output components.

Wireless communications circuitry 28 may include radio-frequency (RF) transceiver circuitry such as transceiver circuitry 24 that is formed from one or more integrated circuits, power amplifier circuitry, low-noise input amplifiers, passive RF components, one or more antennas such as antenna structures 26, and other circuitry for handling RF wireless signals. Wireless signals can also be sent using light (e.g., using infrared communications).

Wireless communications circuitry 28 may include radio-frequency transceiver circuits for handling multiple radio-frequency communications bands. For example, circuitry 28 may include transceiver circuitry 24 for handling cellular telephone communications, wireless local area network signals, and satellite navigation system signals such as signals at 1575 MHz from satellites associated with the Global Positioning System. Transceiver circuitry 24 may handle 2.4 GHz and 5 GHz bands for WiFi® (IEEE 802.11) communications or other wireless local area network communications and may handle the 2.4 GHz Bluetooth® communications band. Circuitry 24 may use cellular telephone transceiver circuitry for handling wireless communications in cellular telephone bands such as the bands in the range of 700 MHz to 2.7 GHz (as examples).

Wireless communications circuitry 28 may include antenna structures 26. Antenna structures 26 may include one or more antennas. Antenna structures 26 may include inverted-F antennas, planar inverted-F antennas, patch antennas, loop antennas, monopoles, dipoles, single-band antennas, dual-band antennas, antennas that cover more than two bands, or other suitable antennas. Configurations in which at least one antenna in device 10 is formed from a planar inverted-F antenna structure such as a dual band planar inverted-F antenna are sometimes described herein as an example. Configurations in which multiple antennas are provided to form an array of antennas and configurations in which antennas are formed within conductive cavities are also sometimes described herein as an example.

To provide antenna structures 26 with the ability to cover communications frequencies of interest, antenna structures 26 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 26 may be provided with adjustable circuits to tune antennas over communications bands of interest.

Transceiver circuitry 24 may be coupled to antenna structures 26 by signal paths such as signal path 30. Signal path 30 may include one or more transmission lines. As an example, signal path 30 of FIG. 2 may be a transmission line having a positive signal conductor such as line 32 and a ground signal conductor such as line 34. Lines 32 and 34 may form parts of a coaxial cable or a microstrip transmission line (as examples). A matching network formed from components such as inductors, resistors, and capacitors may be used in matching the impedance of antenna structures 26 to the impedance of transmission line 30. Matching network components may be provided as discrete components (e.g., surface mount technology components) or may be formed from housing structures, printed circuit board structures, traces on plastic supports, etc. Components such as these may also be used in forming filter circuitry in antenna structures 26.

Transmission line 30 may be coupled to antenna feed structures associated with antenna structures 26. As an example, antenna structures 26 may form an inverted-F antenna (e.g., a planar inverted-F antenna) or other antenna having an antenna feed with a positive antenna feed terminal such as terminal 36 and a ground antenna feed terminal such as ground antenna feed terminal 38. Positive transmission line conductor 32 may be coupled to positive antenna feed terminal 36 and ground transmission line conductor 34 may be coupled to ground antenna feed terminal 38. Other types of antenna feed arrangements may be used if desired. The illustrative feeding configuration of FIG. 2 is merely illustrative.

FIG. 3 is a cross-sectional side view of device 10 in an illustrative configuration in which device 10 has conductive housing sidewalls 40 that define antenna cavity 14. Antenna structures 26 may be mounted within cavity 14 and may, if desired, be covered with an optional cosmetic cover structure such as dome structure 42. Dome 42 may be formed from a dielectric such as plastic, glass, ceramic, or other non-conductive material and may, if desired, be used as a loading (tuning) element for antenna structures 26. Housing sidewalls 40 (sometimes referred to as antenna cavity walls) may be formed from a metal such as aluminum, stainless steel, or other metals. A circular opening A or an opening of other suitable shape may be formed at the top of cavity 14. Optional cavity wall portions 40' may narrow the opening at the upper end of cavity 14. Cavity floor (lower housing wall) 40" may also be formed from a metal such as aluminum, stainless steel, or other metals. If desired, cavity 14 may be formed at the upper end of device 10 (i.e., internal device components may be located below cavity wall 40").

Cavities of the type shown in FIG. 3 may sometimes be referred to as forming deep cavity structures (i.e., in scenarios in which cavity depth D is greater than lateral inner cavity dimensions, etc.). The size and shape of cavity 14 may present challenges when configuring the antenna structures of device 10 to exhibit desired antenna performance (e.g., bandwidth, efficiency, amounts of coupling between antennas and the cavity in which the antennas are mounted, etc.), particularly when D is relatively large and when antenna structures 26 are located at or near the bottom of cavity 14 (e.g., when it is desired to place antenna structures 26 deep within cavity 14 for aesthetic reasons or to satisfy other design constraints).

Figure 4:
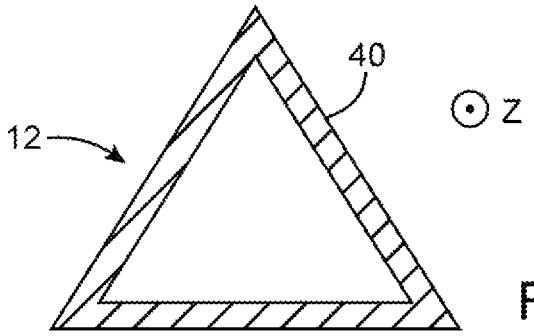
FIG. 4 is a cross-sectional top view of an illustrative device housing with a triangular footprint in accordance with an embodiment.
Figure 5:
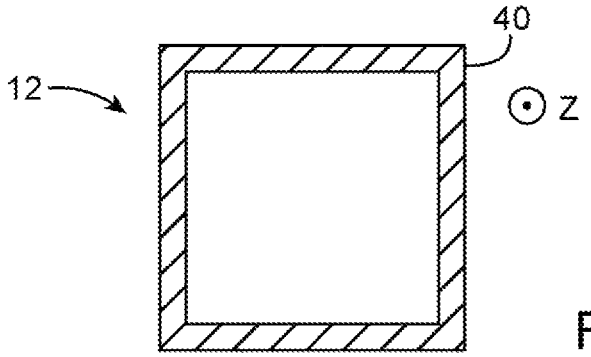
FIG. 5 is a cross-sectional top view of an illustrative device housing with a rectangular footprint in accordance with an embodiment.
Figure 6:
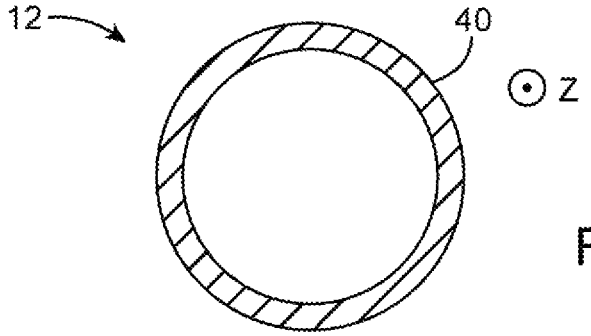
FIG. 6 is a cross-sectional top view of an illustrative device housing with a circular footprint in accordance with an embodiment.

FIG. 4 is a cross-sectional top view of housing 12 showing how housing walls 40 may have a triangular cross-sectional shape. The cross-sectional top view of housing 12 in FIG. 5 shows how housing 12 may have sidewalls 40 with other shapes such as a rectangular (e.g., a square) shape. In the illustrative configuration of FIG. 6, housing 12 has housing sidewalls 40 that form a cylindrical cavity (i.e., housing walls 40 have a circular shape, so that housing 12, walls 40, and the opening at the top of cavity 14 are characterized by a circular footprint).

Figure 7:
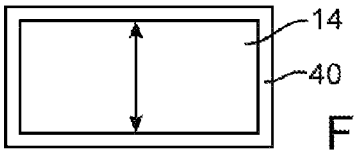
FIGS. 7, 8, and 9 are cross-sectional top views of an illustrative electronic device having housing walls that form a rectangular cavity showing cavity modes that are supported by the cavity in accordance with an embodiment.
Figure 8:
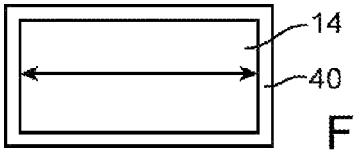
Figure 9:
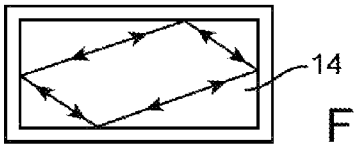
Figure 10:
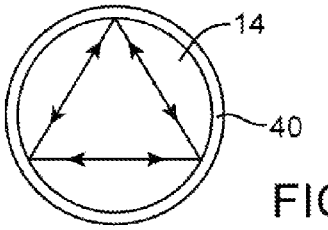
FIGS. 10 and 11 are cross-sectional top views of an illustrative electronic device having housing walls that form a circular cavity showing cavity modes that are supported by the cavity in accordance with an embodiment.
Figure 11:
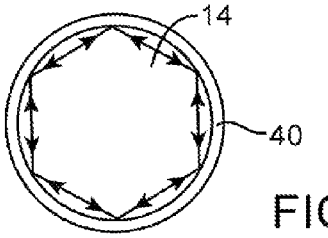
Figure 12:
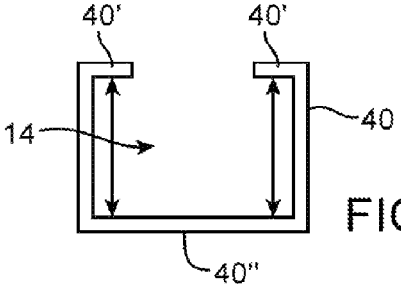
FIG. 12 is a cross-sectional side of view of an illustrative electronic device having housing walls with a lip that supports cavity modes in accordance with an embodiment.

The shape used for cavity 14 influences which antenna cavity modes are supported. Cavity modes are associated with trapped standing wave modes that do not radiate efficiently. FIGS. 7, 8, and 9 show illustrative antenna modes of the type that may be supported by cavity 14 in a configuration in which cavity 14 has a rectangular footprint. FIGS. 10 and 11 show illustrative cavity modes of the type that may be supported in a cylindrical cavity (i.e., a cavity with a circular footprint). FIG. 12 shows how the presence of lip portions 40' on cavity walls 40 may give rise to vertical cavity modes.

Figure 13:
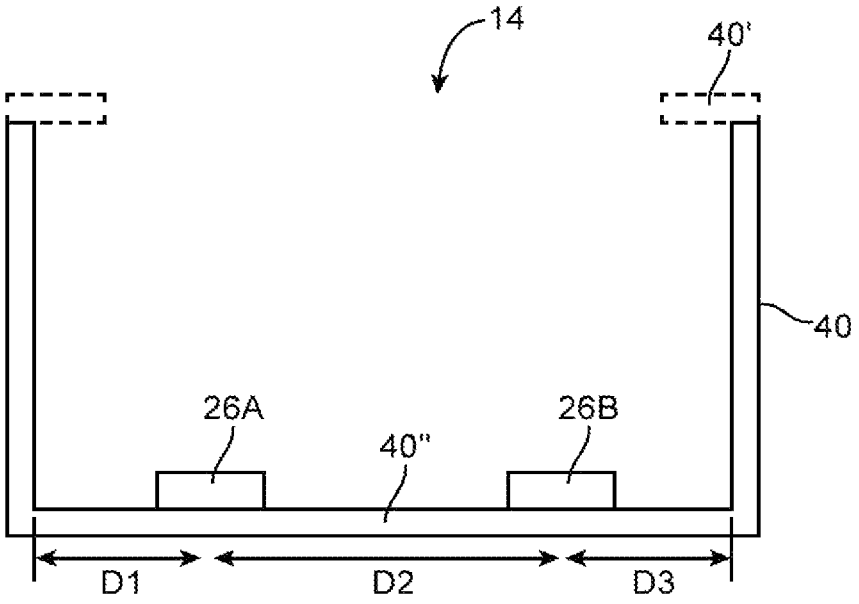
FIG. 13 is a cross-sectional side view of an illustrative electronic device showing how placement of antennas within a cavity formed from housing walls influences antenna performance in accordance with an embodiment.

There may be any suitable number of antennas within cavity 14 (i.e., antenna structures 26 may include one or more antennas in cavity 14, two or more antennas in cavity 14, three or more antennas in cavity 14, or four or more antennas in cavity 14). The antennas may tend to couple to cavity modes of the type shown in FIGS. 7, 8, 9, 10, 11, and 12, when the antennas are located close to cavity walls (i.e., when distances D1 and D3 of illustrative antennas 26A and 26B of FIG. 13 are small). At the same time, coupling between antennas (which should generally be minimized to maximize wireless performance in an antenna array), is increased when D1 and D3 are large and the separation D2 between antennas is smaller. To satisfy these competing concerns without making device 10 overly bulky, distances D1 and D3 are generally increased as much as possible without causing antenna coupling due to small D2 values to rise above a desired threshold amount.

Figure 14:
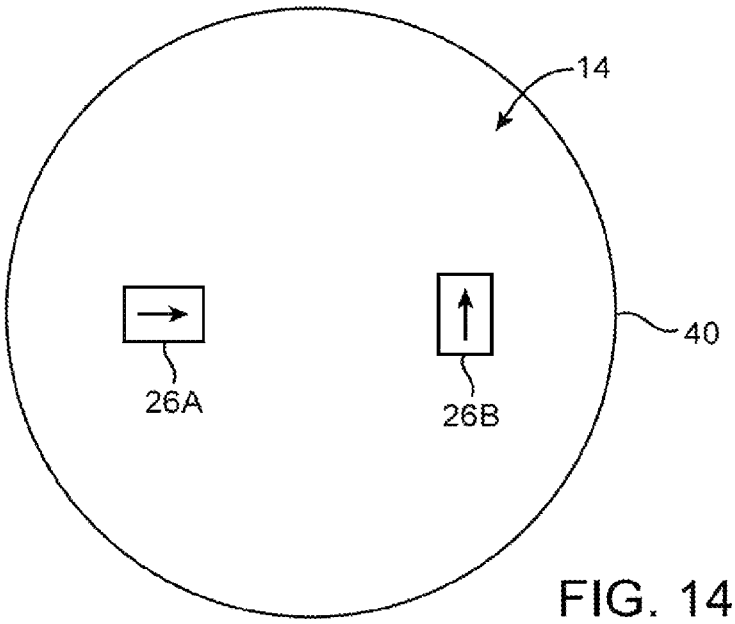
FIG. 14 is a top view of a pair of antennas with diverse polarizations in a housing that forms a circular antenna cavity in accordance with an embodiment.
Figure 15:
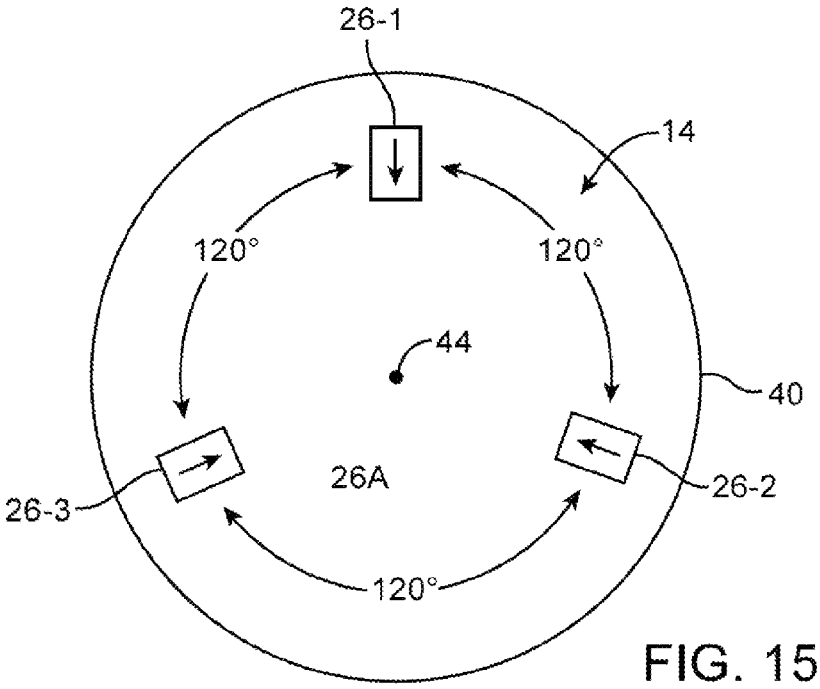
FIG. 15 is a top view of three antennas with three respective different polarization orientations in a housing that forms a circular antenna cavity in accordance with an embodiment.

Antenna array performance can be enhanced (i.e., antenna-to-antenna coupling can be decreased) by arranging the antennas of device 10 to exhibit polarization diversity (i.e., different polarization orientations). In the example of FIG. 14, a pair of antennas has been oriented so that the first antenna 26A has a polarization that is orthogonal to the second antenna 26B. In the example of FIG. 15, antennas 26-1, 26-2, and 26-3 have been arranged to exhibit 120° angular separations with respect to each other within a cylindrical cavity 14 while orienting the polarization of each antenna towards center point 44 to ensure satisfactory polarization diversity (i.e., to ensure that each antenna's polarization orientation is different).

Figure 16:
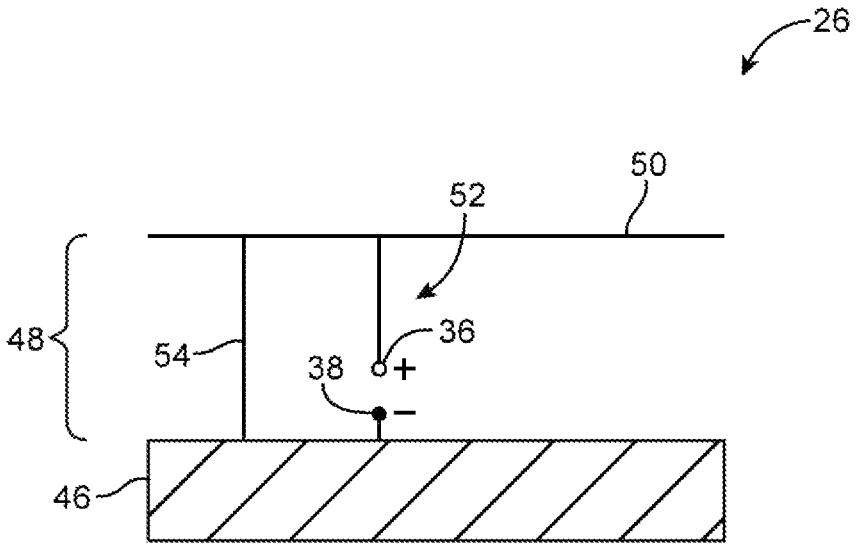
FIG. 16 is a diagram of an illustrative inverted-F antenna in accordance with an embodiment.

Antennas in device 10 may, if desired, be inverted-F antennas (e.g., planar inverted-F antennas). An illustrative inverted-F antenna is shown in FIG. 16. Antenna 26 of FIG. 16 has antenna ground 46 and antenna resonating element 48. In device 10, antenna ground 46 may be formed form the antenna cavity that is formed from housing wall 40.

The antenna feed for antenna 26 includes positive feed terminal 36 and ground antenna feed terminal 38 in feed branch 52. Return path 54 couples main resonating element arm 50 to ground 46 in parallel with feed branch 52. Main resonating element arm 50 may, if desired, have long and short branches to help antenna 26 cover multiple frequency bands of interest (e.g., a high band at a high-band frequency of 5 GHz, a low band at a low-band frequency of 2.4 GHz, etc.). In a planar inverted-F antenna configuration, arm 50 of resonating element 48 may be formed from a planar metal structure (i.e., a planar metal element extending into the page in the orientation of FIG. 16).

Figure 17:
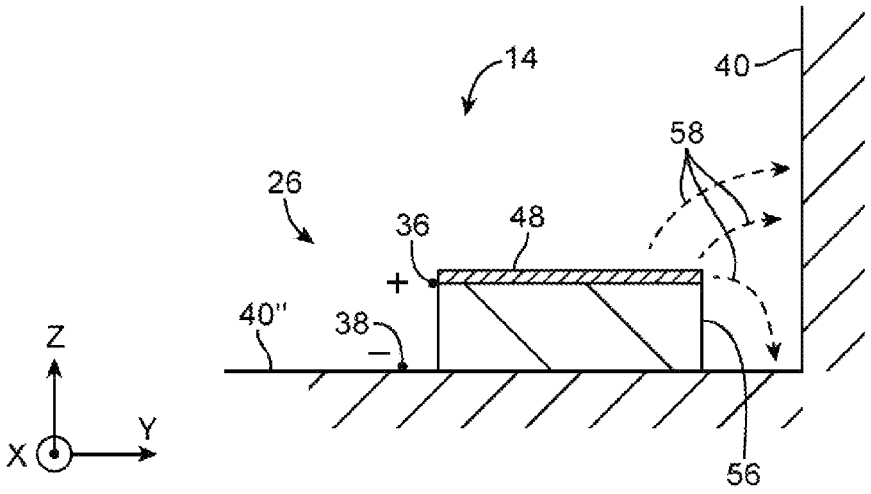
FIG. 17 is a cross-sectional side view of a planar inverted-F antenna that is adjacent to a housing wall and that is fed using a feed on the inner side of the antenna in accordance with an embodiment.
Figure 18:
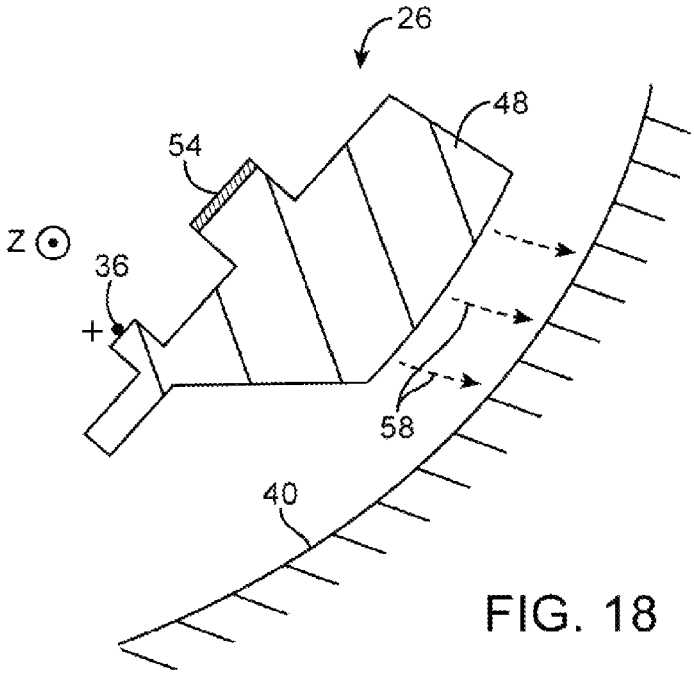
FIG. 18 is a top view of the antenna of FIG. 17 in accordance with an embodiment.

FIG. 17 is a cross-sectional side view of an illustrative antenna in a cavity in device 10. As shown in FIG. 17, antenna 26 includes antenna resonating element 48. Antenna resonating element 48 may be formed from metal traces on a dielectric carrier such as carrier 56 (e.g., planar metal traces that lie in a plane parallel to the X-Y plane of FIG. 17 mounted on a plastic carrier). Antenna 26 may have an antenna feed formed from feed terminals 36 and 38. In the configuration of FIG. 17, the antenna feed is formed on the inner side of antenna 26 (i.e., the edge of resonating element 48 that is positioned close to the center of cavity 14 and that is farther from adjacent cavity sidewall 40). Illustrative electromagnetic field lines 58 of FIG. 17 and the associated top view of antenna 26 shown in FIG. 18 show how at an operating frequency such as 2.4 GHz, resonant currents may flow close to cavity wall 40 and may cause antenna 26 to capacitively couple to cavity wall 40, tending to decrease antenna bandwidth and efficiency.

Figure 19:
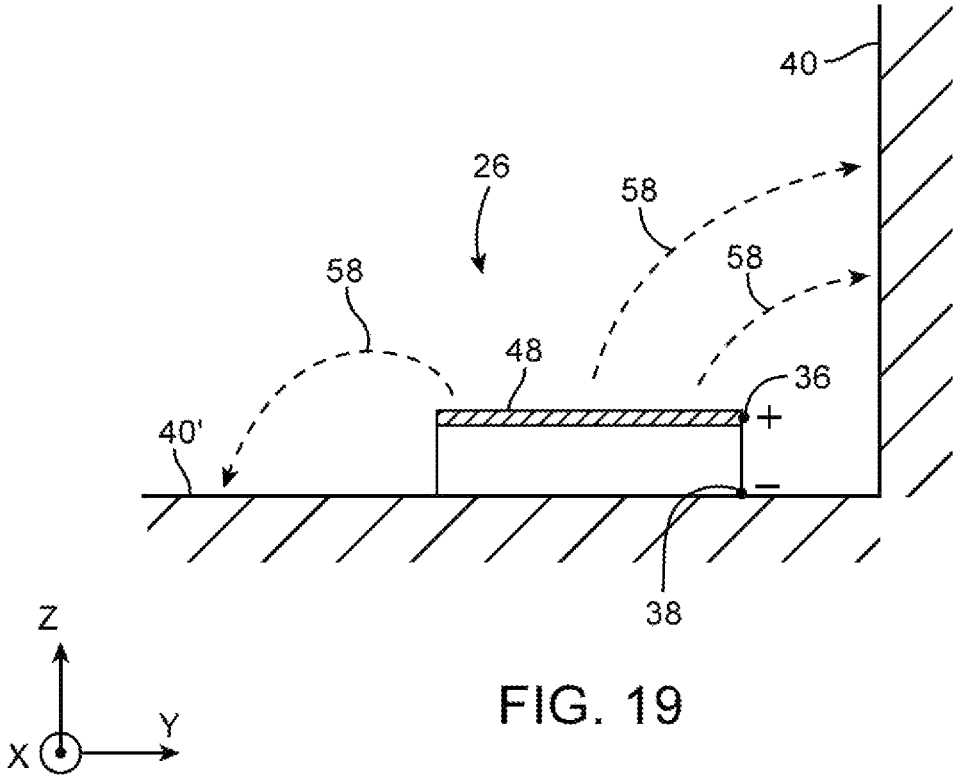
FIG. 19 is a cross-sectional side view of a planar inverted-F antenna that is adjacent to a housing wall and that is fed using a feed on the outer side of the antenna in accordance with an embodiment.
Figure 20:
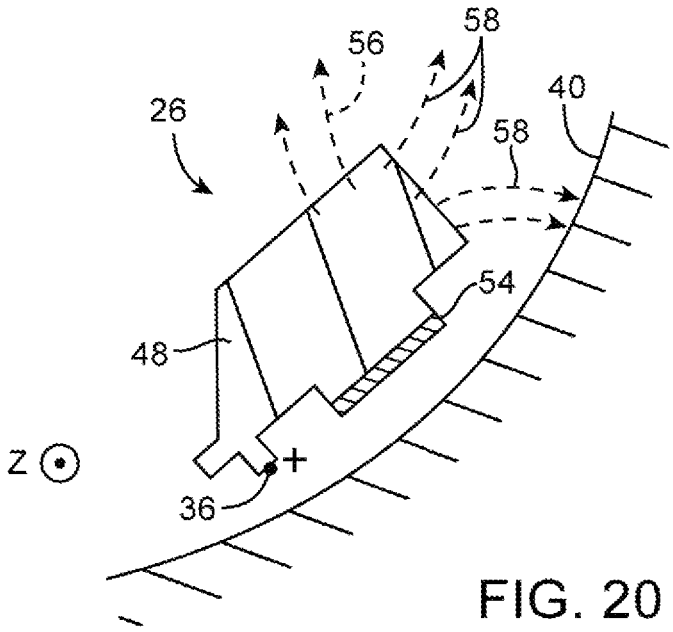
FIG. 20 is a top view of the antenna of FIG. 19 in accordance with an embodiment.

FIGS. 19 and 20 illustrate an alternative configuration for antenna 26 in which the feed is formed on the outer side of antenna 26 (i.e., the edge of resonating element 48 that is positioned farthest from the center of cavity 14 and closer to adjacent cavity sidewall 40). As shown by illustrative electromagnetic field lines 58 of FIGS. 19 and 20, this type of configuration may produce lower amounts of coupling between antenna 26 and the cavity (i.e., less cavity mode excitation will be exhibited), which tends to increase antenna bandwidth and efficiency.

Figure 21:
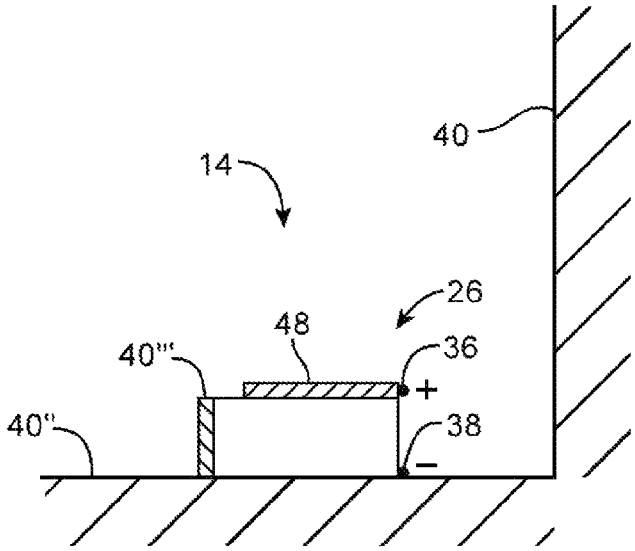
FIG. 21 is a cross-sectional side view of a planar inverted-F antenna that located between a housing wall and an inner side wall structure and that is fed using a feed on the outer side of the antenna in accordance with an embodiment.
Figure 22:
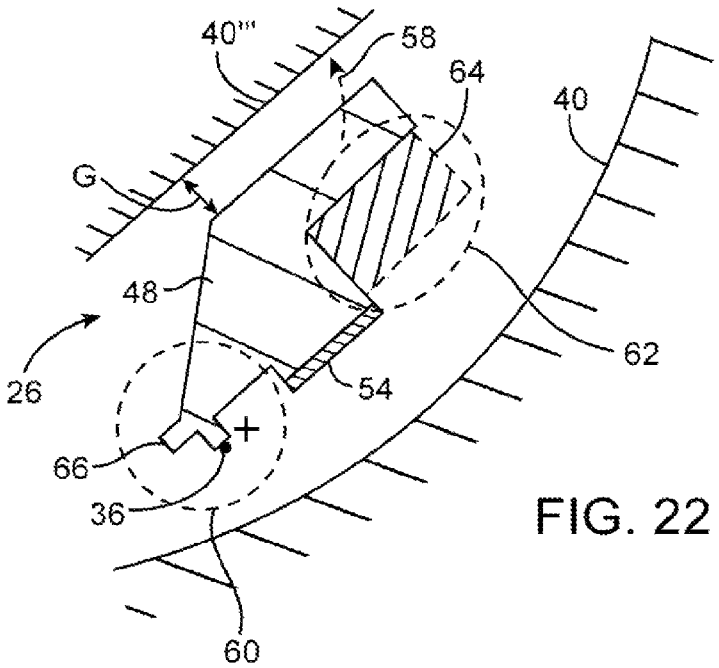
FIG. 22 is a top view of the antenna of FIG. 21 in accordance with an embodiment.

Yet another illustrative antenna configuration is shown in FIGS. 21 and 22. In this configuration, inner cavity wall 40' has been formed adjacent to the inner edge of antenna resonating element 48. Inner cavity wall 40' may have a circular shape that is nested within circular housing wall 40. Return path 54 and the antenna feed may be formed on the opposing outer edge of antenna resonating element 48, adjacent to cavity wall 40. Cut-out portion 64 may be removed from resonating element 48 (i.e., area 64 may be free of metal). As shown by electromagnetic field line 58 in FIG. 22, this configuration may force more of the antenna currents (e.g., currents flowing when operating antenna 26 at an operating frequency such as 2.4 GHz) away from cavity wall 40 and may cause more of the electromagnetic fields 58 to be directed away from cavity wall 40. Rather than being coupled to cavity modes, the fields produced by antenna 26 of FIGS. 21 and 22 may tend to be coupled to radiative modes (e.g., modes that allow radio-frequency antenna signals to pass through the opening at the top of cavity 14), thereby enhancing antenna efficiency.

Inner edge 48' of antenna resonating element 48 may be separated from inner cavity wall structure 40''' by distance G. Decreases in the magnitude of G may increase capacitive loading and may help reduce antenna size. Reductions in antenna size, in turn, may help reduce coupling between the individual antennas in an antenna array. Excessive reductions in gap G are preferably avoided to prevent overly large reductions in bandwidth.

The presence of cut-out portion 64 of antenna resonating element 48 in region 62 (i.e., the absence of metal in region 64) and the presence of protrusion 66 of antenna resonating element 48 in region 60 may give rise to high band antenna resonances (e.g., resonances at 5 GHz), thereby allowing antenna 26 to function as a dual band antenna (i.e., a 2.4 GHz and 5 GHz antenna).

Figure 23:
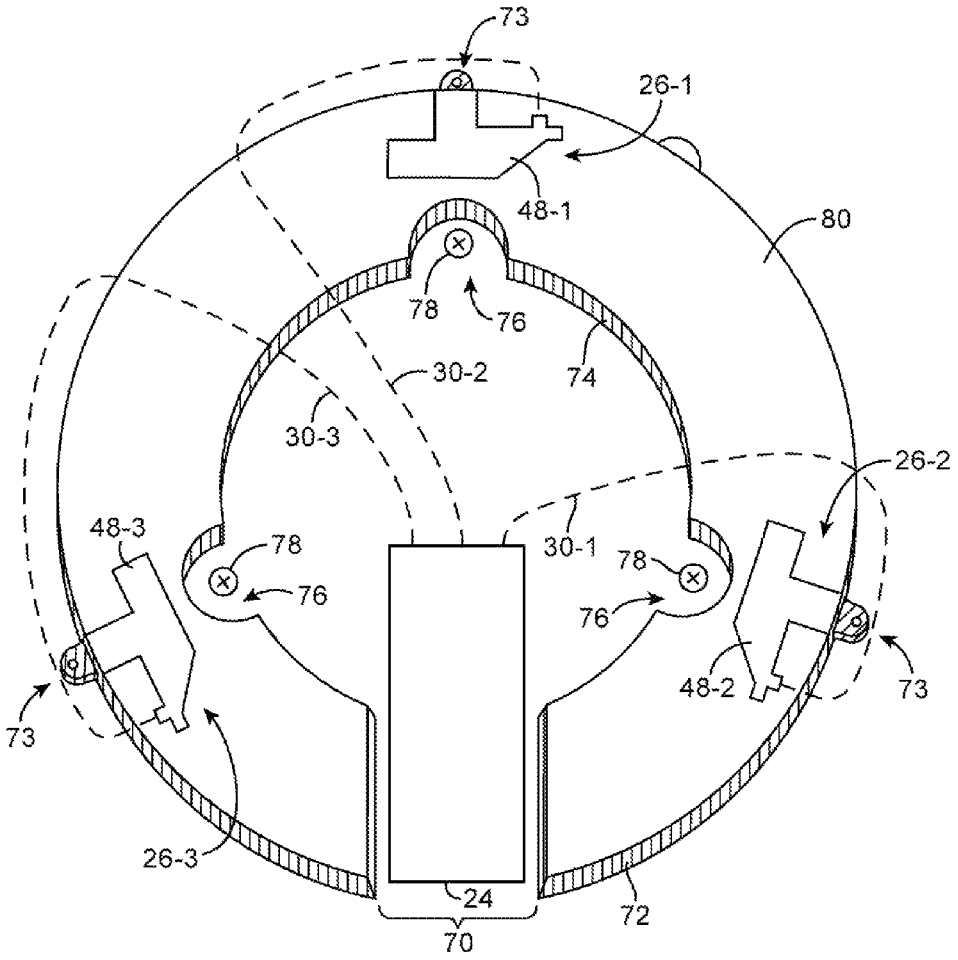
FIG. 23 is a perspective view of an illustrative array of antennas formed on a horseshoe-shaped plastic carrier with metal structures in accordance with an embodiment.

FIG. 23 shows how an array of antennas of the type shown in FIGS. 21 and 22 may be formed from patterned metal traces on a dielectric carrier. The dielectric carrier may be a horseshoe shaped plastic carrier such as carrier 80 having opposing ends separated by gap 70. Carrier 80 may form a carrier such as the illustrative carrier 56 of FIG. 21. Antennas 26-1, 26-2, and 26-3 may be arranged on carrier 80 as described in FIG. 15 to exhibit polarization diversity and minimized coupling.

The antenna array of FIG. 23 may be mounted within a metal cylindrical housing in which the antenna array has an outer housing sidewall 40 and an inner wall structure 40''' (e.g., a concentric inner wall structure). Metal traces may be used to form antenna resonating element 48-1 for antenna 26-1, antenna resonating element 48-2 for antenna 26-2, and antenna resonating element 48-3 for antenna 26-3. Metal traces on the horseshoe-shaped plastic carrier may also be used to form outer trace 72 and inner trace 74. Outer trace 72 may be a vertically extending circular metal trace on the outer edge of the horseshoe-shaped carrier that lies along the inner surface of a mating cylindrical housing sidewall 40 when the antenna structures of FIG. 23 are mounted in cavity 14. Inner trace 74 may form some or part of inner wall 40' (see, e.g., inner wall 40' of FIGS. 21 and 22) Inner trace 74 may be a vertically extending wall that is circular in shape and concentric with circular outer trace 72.

Transceiver circuitry 24 (e.g., a printed circuit board such as a radio card) may be located in gap 70. Cables (e.g., coaxial cables) or other transmission lines such as transmission lines 30-1, 30-2, and 30-3 may be used to route signals between transceiver circuitry 24 and antennas 26-1, 26-2, and 26-3. Solder or other conductive structures may be used in attaching transmission lines to the metal structures of the antennas. Recesses 76 may be formed in carrier 80 to accommodate screws 78 or other functional portions of device 10. Protrusions 73 such as tabs with screw holes or other mounting structures may be incorporated into carrier 80 to facilitate mounting within housing 12. If desired, some of the antennas in the antenna array of FIG. 23 may be implemented using mirrored (flipped) configurations (see, e.g., resonating element 48-3 which is mirrored with respect to resonating elements 48-1 and 48-2). Donut-shaped carriers (e.g., a ring without gaps such as gap 70) and other types of carriers may be used in mounting antenna structures in cavity 14. The use of horseshoe shaped carrier 80 of FIG. 23 having a circular ring shape that is received within the circular interior of a cylindrical housing is merely illustrative.

Figure 24:
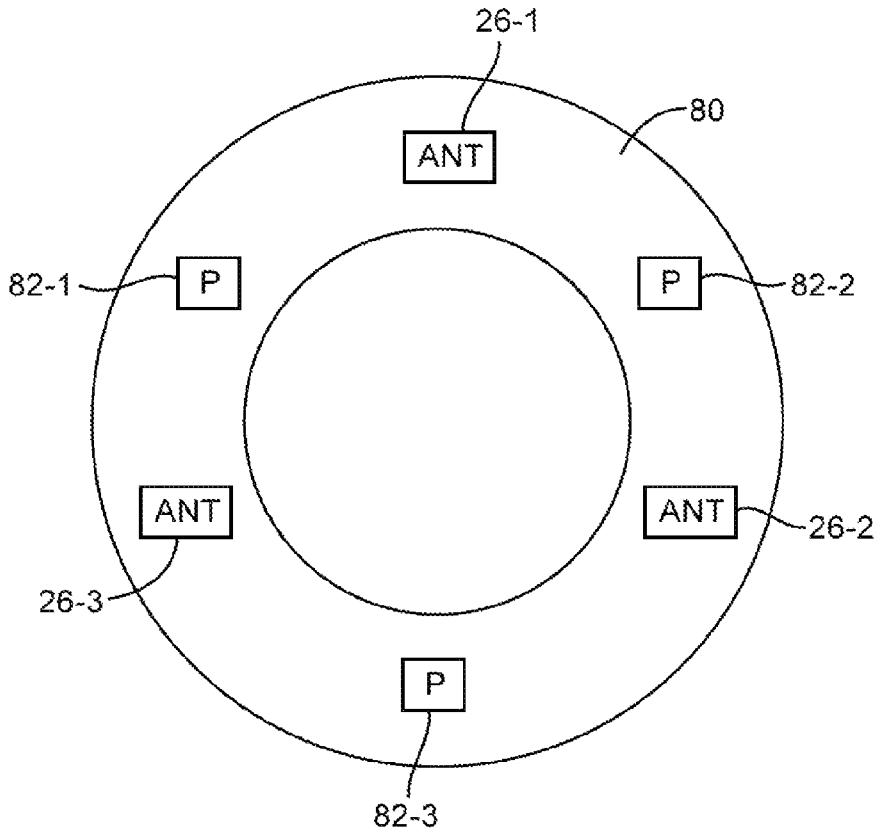
FIG. 24 is a perspective view of a ring-shaped antenna array having three antennas separated by three respective parasitic resonating elements to help isolate the antennas from each other in accordance with an embodiment.
Figure 25:
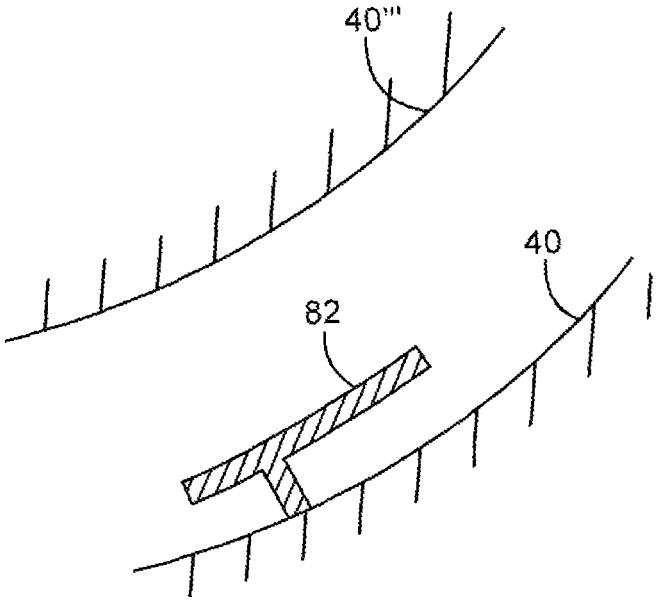
FIG. 25 is a top view of an illustrative parasitic resonating element in accordance with an embodiment.

If desired, isolation between respective antennas may be enhanced by incorporating one or more parasitic antenna resonating elements into the antenna array. As shown in FIG. 24, for example, parasitic antenna resonating element 82-1 may be located between antenna 26-3 and antenna 26-1 to help electromagnetically isolate antennas 26-3 and 26-1 from each other, parasitic antenna resonating element 82-2 may be located between antenna 26-1 and antenna 26-2 to help electromagnetically isolate antennas 26-1 and 26-2 from each other, and parasitic antenna resonating element 82-3 may be located between antenna 26-2 and antenna 26-3 to help electromagnetically isolate antennas 26-2 and 26-3 from each other (i.e., antennas and parasitic elements may be arranged in a circle in an alternating pattern). An illustrative T-shaped parasitic antenna resonating element trace (trace 82) that may be used in forming each parasitic resonating element of FIG. 24 is shown in FIG. 25. Parasitic antenna resonating element 82 of FIG. 25 may have a long arm for resonating at 2.4 GHz (and therefore helping to isolate antennas operating at 2.4 GHz) and may have a short arm for resonating at 5 GHz (and therefore helping to isolate antennas operating at 5 GHz). Isolation may also be provided at other frequencies. The use of a parasitic antenna resonating element that provides isolation at 2.4 GHz and 5 GHz is merely illustrative.

Figure 26:
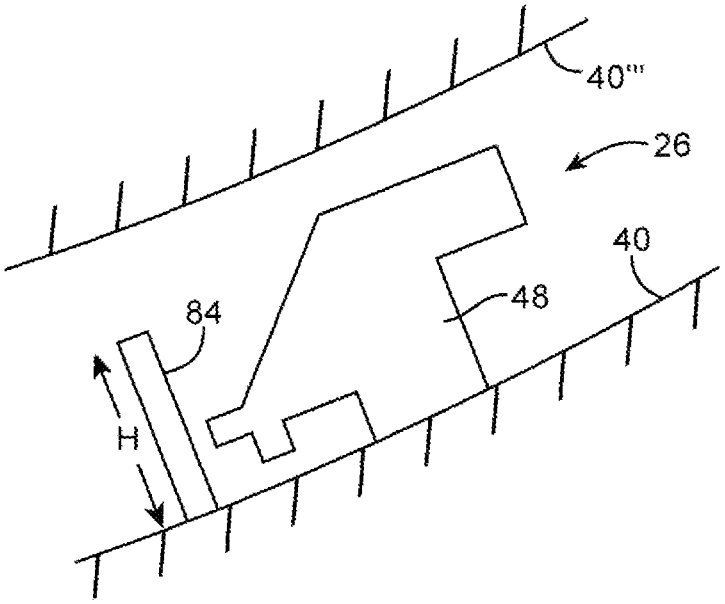
FIG. 26 is a top view of an illustrative dual-band planar inverted-F antenna having an associated strip-shaped parasitic resonating element in accordance with an embodiment.

FIG. 26 shows how a parasitic antenna resonating element may be added to each antenna 26 in the antenna array to help configure the frequency response of antenna 26. Resonating element 84 may, as an example, be formed from a strip-shaped metal trace (i.e., a metal strip) that extends outwards from housing wall 40 adjacent to resonating element 48 of antenna 26. The height H of resonating element 84 may be adjusted to configure the frequency response of parasitic antenna resonating element 84 and therefore antenna 26 of FIG. 26.

Figure 27:
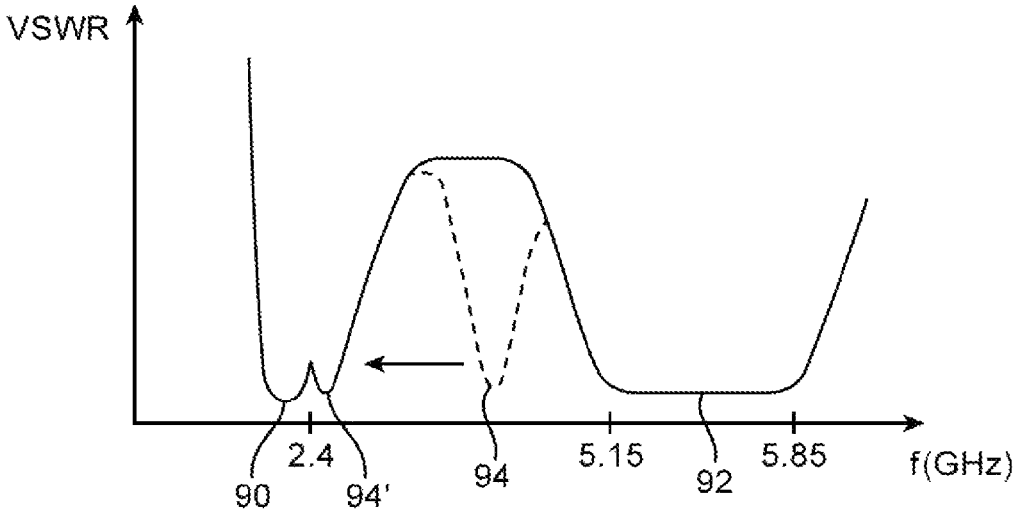
FIG. 27 is a graph in which antenna performance (voltage standing wave ratio) for an antenna of the type shown in FIG. 26 has been plotted as a function of operation frequency in accordance with an embodiment.

FIG. 27 is a graph in which antenna performance (voltage standing wave ratio) has been plotted as a function of operating frequency f. As shown in FIG. 27, antenna 26 may be a dual band antenna that exhibits a first resonance in a low communications band (e.g., a frequency band at 2.4 GHz, as illustrated by resonance 90) and that exhibits a second resonance in a high communications band (e.g., a frequency band at 5 GHz, as illustrated by resonance 92). Peak 94 may be associated with parasitic resonating element 84. By increasing H, the resonance associated with parasitic resonating element 84 may be moved from the position of peak 94 in FIG. 27 to the position of peak 94' in FIG. 27, merging with the low band resonance of resonating element 48 and effectively broadening the low band resonance for antenna 26.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a cylindrical metal housing forming an antenna cavity;

antenna resonating element structures in the antenna cavity, wherein the antenna resonating element structures and the antenna cavity form an array of antennas in the cylindrical metal housing, the array of antennas comprise first, second, and third antennas, and the first, second and third antennas comprise planar inverted-F antennas; and an inner cavity wall that lies within the cylindrical metal housing, wherein the first antenna lies between the inner cavity wall and the cylindrical metal housing, the second antenna lies between the inner cavity wall and the cylindrical metal housing, and the third antenna lies between the inner cavity wall and the cylindrical metal housing.

2. The electronic device defined in claim 1 wherein each of the planar inverted-F antennas comprises a respective metal trace with a cut-out region adjacent to the cylindrical metal housing.

3. The electronic device defined in claim 1 wherein the first, second, and third antennas are separated from each other by 120°.

4. The electronic device defined in claim 1 wherein the antenna resonating element structures comprise metal traces on a dielectric carrier.

5. The electronic device defined in claim 4 wherein the dielectric carrier comprises a plastic carrier with a horseshoe shape.

6. The electronic device defined in claim 1 further comprising:

radio-frequency transceiver circuitry; and cables that couple the radio-frequency transceiver circuitry to the first, second, and third antennas.

7. The electronic device defined in claim 1 wherein the first, second, and third antennas each have a different respective polarization orientation.

* * * * *